US012460339B2

(12) United States Patent
Zhao et al.

(10) Patent No.: US 12,460,339 B2
(45) Date of Patent: Nov. 4, 2025

(54) FEEDING DEVICE FOR LAUNDRY TREATMENT APPARATUS, AND LAUNDRY TREATMENT APPARATUS

(71) Applicants: QINGDAO HAIER WASHING MACHINE CO., LTD., Shandong (CN); Haier Smart Home Co., Ltd., Shandong (CN)

(72) Inventors: Zhiqiang Zhao, Qingdao (CN); Sheng Xu, Qingdao (CN)

(73) Assignees: QINGDAO HAIER WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 283 days.

(21) Appl. No.: 18/550,692

(22) PCT Filed: Jan. 29, 2022

(86) PCT No.: PCT/CN2022/074948
§ 371 (c)(1),
(2) Date: Sep. 15, 2023

(87) PCT Pub. No.: WO2022/193859
PCT Pub. Date: Sep. 22, 2022

(65) Prior Publication Data

US 2024/0158980 A1 May 16, 2024

(30) Foreign Application Priority Data

Mar. 16, 2021 (CN) ..... 202110281184.3

(51) Int. Cl.
*D06F 39/02* (2006.01)

(52) U.S. Cl.
CPC ..... *D06F 39/02* (2013.01)

(58) Field of Classification Search
None
See application file for complete search history.

(56) References Cited

FOREIGN PATENT DOCUMENTS

CN 203373569 U 1/2014
CN 203374479 U 1/2014
(Continued)

OTHER PUBLICATIONS

CN 211227751 U, A Detergent Feeding Mechanism For Washing Machine, Wang (Year: 2020).*
(Continued)

*Primary Examiner* — Cristi J Tate-Sims
(74) *Attorney, Agent, or Firm* — Maier & Maier, PLLC

(57) ABSTRACT

A feeding device for a laundry treatment apparatus and a laundry treatment apparatus. The feeding device for a laundry treatment apparatus includes a gear rod, a driving portion, mounting bodies, feeding rods and gears. The gear rod is rotationally arranged between the two mounting bodies, and the driving portion is in transmission connection with the gear rod; the two feeding rods are rotationally arranged between the two mounting bodies; first ends of the two feeding rods are provided with limiting portions; second ends of the two feeding rods are provided with sliding portions; threaded portions are arranged between the limiting portions and the sliding portions; the two gears are provided with threaded holes, are in threaded connection with the two threaded portions by the threaded holes and are meshed with the gear rod; and the two feeding rods are connected to transmission assemblies of two detergent feeding chambers.

10 Claims, 3 Drawing Sheets

(56) References Cited

FOREIGN PATENT DOCUMENTS

| | | | | | |
|---|---|---|---|---|---|
| CN | 103866538 | A | | 6/2014 | |
| CN | 104562563 | A | | 4/2015 | |
| CN | 205478230 | U | | 8/2016 | |
| CN | 109853191 | A | | 6/2019 | |
| CN | 209678447 | U | | 11/2019 | |
| CN | 211227751 | U | | 8/2020 | |
| DE | 102008042654 | A1 | | 4/2010 | |
| EP | 3673107 | B1 | * | 11/2022 | ..... D06F 39/02 |
| WO | 2020233871 | A1 | | 11/2020 | |

OTHER PUBLICATIONS

International Search Report mailed on Mar. 28, 2022 in corresponding International Application No. PCT/CN2022/074948; 6 pages.

* cited by examiner

FEEDING DEVICE FOR LAUNDRY TREATMENT APPARATUS, AND LAUNDRY TREATMENT APPARATUS

FIELD

The present disclosure belongs to the technical field of clothing treatment apparatus, and specifically provides a dispensing device for a clothing treatment apparatus, and a clothing treatment apparatus.

BACKGROUND

A washing machine is a widely used household appliance. The washing machine is usually provided therein with a detergent dispenser, which is used to add a detergent into a washing cylinder. In order to achieve a better cleaning effect on clothing while also caring or sterilizing the clothing, different detergents such as washing liquid and softener need to be dispensed for washing in a washing process of the washing machine. In the prior art, in order to solve the problem of dispensing different types of detergents, a dispensing device is generally provided with two dispensing pump devices, which are used to extract detergents from different storage boxes. When it is required to add the detergent, the pump system corresponding to the detergent is used to suction the washing liquid from a washing liquid storage box and dispense it into the washing cylinder. However, this requires two sets of pumping systems which are each provided with a respective pumping structure and each correspond to a motor. This arrangement has a complicated structure and increases use cost.

Accordingly, there is a need for a new dispensing device for a clothing treatment apparatus and a new clothing treatment apparatus in the art to solve the problem of complicated structure caused by the use of two sets of pumping structures and motors in the dispensing devices of existing washing machines.

SUMMARY

In order to solve the above problem in the prior art, that is, to solve the problem of complicated structure caused by the use of two sets of pumping structures and motors in the dispensing devices of existing washing machines, the present disclosure provides a dispensing device for a clothing treatment apparatus, and a clothing treatment apparatus; the dispensing device includes: two installation bodies; a power unit, which includes a driving part and a gear lever, in which the gear lever is rotatably arranged between the two installation bodies, and the driving part is drivingly connected to the gear lever; a first dispensing unit, which includes a first dispensing rod and a first gear, in which the first dispensing rod is rotatably arranged between the two installation bodies, a first end of the first dispensing rod is provided with a first limiting part, and a second end of the first dispensing rod is provided with a first slippery part; a first threaded part is arranged between the first limiting part and the first slippery part; the first gear is provided with a threaded hole, and the first gear is threadedly connected to the first threaded part through the threaded hole; after being connected, the first gear is meshed and connected to the gear lever, and the first dispensing rod is connected to a first transmission assembly of a first detergent dispensing chamber; and a second dispensing unit, which includes a second dispensing rod and a second gear, in which the second dispensing rod is rotatably arranged between the two installation bodies, a first end of the second dispensing rod is provided with a second limiting part, and a second end of the second dispensing rod is provided with a second slippery part; a second threaded part is arranged between the second limiting part and the second slippery part; the second gear is provided with a threaded hole, and the second gear is threadedly connected to the second threaded part through the threaded hole; after being connected, the second gear is meshed and connected to the gear lever, and the second dispensing rod is connected to a second transmission assembly of a second detergent dispensing chamber; when the driving part drives the gear lever to rotate in a forward direction, the first gear moves to reach the first limiting part and drives the first dispensing rod to rotate, so that the first dispensing rod drives the first transmission assembly to move to achieve dispensing of detergent inside the first detergent dispensing chamber, and at the same time, the second gear reaches the second slippery part to achieve slip-rotation; and when the driving part drives the gear lever to rotate in a reverse direction, the second gear moves to reach the second limiting part and drives the second dispensing rod to rotate, so that the second dispensing rod drives the second transmission assembly to move to achieve dispensing of detergent inside the second detergent dispensing chamber, and at the same time, the first gear reaches the first slippery part to achieve slip-rotation.

In a preferred technical solution of the dispensing device for the clothing treatment apparatus described above, the first limiting part and the second limiting part are located on the same side, the first slippery part and the second slippery part are located on the same side, and the first threaded part and the second threaded part have different helical directions of thread.

In a preferred technical solution of the dispensing device for the clothing treatment apparatus described above, the first limiting part and the second slippery part are located on the same side, the second limiting part and the first slippery part are located on the same side, and the first threaded part and the second threaded part have the same helical direction of thread.

In a preferred technical solution of the dispensing device for the clothing treatment apparatus described above, the first dispensing unit further includes a first elastic member, which is located on a side close to the first slippery part, provided between the installation body and the first threaded part, and arranged on a movement travel of the first gear; and/or the second dispensing unit further includes a second elastic member, which is located on a side close to the second slippery part, provided between the installation body and the second threaded part, and arranged on a movement travel of the second gear.

In a preferred technical solution of the dispensing device for the clothing treatment apparatus described above, the first elastic member is sleeved over the first slippery part, and/or the second elastic member is sleeved over the second slippery part.

In a preferred technical solution of the dispensing device for the clothing treatment apparatus described above, a first gasket is arranged between the first elastic member and the first threaded part, as well as between the first elastic member and the installation body, and/or a second gasket is arranged between the second elastic member and the second threaded part, as well as between the second elastic member and the installation body.

In a preferred technical solution of the dispensing device for the clothing treatment apparatus described above, the first slippery part and the second slippery part are smooth columnar rods.

In a preferred technical solution of the dispensing device for the clothing treatment apparatus described above, the first limiting part and the second limiting part are of an annular convex structure.

A first piston chamber is arranged inside the first detergent dispensing chamber, and the first piston chamber is provided with a first detergent inlet and a first detergent outlet; a one-way valve is arranged at the first detergent inlet and the first detergent outlet respectively; the first transmission assembly includes a first cam, a first connecting rod, and a first piston; the first dispensing rod is fixedly connected to the first cam, the first cam is hinged with the first connecting rod, the first connecting rod is hinged with the first piston, and the first piston is movably arranged in the first piston chamber; a second piston chamber is arranged inside the second detergent dispensing chamber, and the second piston chamber is provided with a second detergent inlet and a second detergent outlet; a one-way valve is arranged at the second detergent inlet and the second detergent outlet respectively; the second transmission assembly includes a second cam, a second connecting rod, and a second piston; the second dispensing rod is fixedly connected to the second cam, the second cam is hinged with the second connecting rod, the second connecting rod is hinged with the second piston, and the second piston is movably arranged in the second piston chamber.

The present disclosure also provides a clothing treatment apparatus, which includes the dispensing device for a clothing treatment apparatus described in any of the above technical solutions.

It can be understood by those skilled in the art that in the technical solutions of the present disclosure, when the driving part drives the gear lever to rotate in a forward direction, the first gear moves toward the first limiting part and the second gear moves toward the second slippery part until the first gear moves to reach the first limiting part and drives the first dispensing rod to rotate, so that the first dispensing rod drives the first transmission assembly to move to achieve dispensing of detergent inside the first detergent dispensing chamber, and at the same time, the second gear reaches the second slippery part to achieve slip-rotation; and when the driving part drives the gear lever to rotate in a reverse direction, the first gear moves toward the first slippery part and the second gear moves toward the second limiting part until the second gear moves to reach the second limiting part and drives the second dispensing rod to rotate, so that the second dispensing rod drives the second transmission assembly to move to achieve dispensing of detergent inside the second detergent dispensing chamber, and at the same time, the first gear reaches the first slippery part to achieve slip-rotation.

Through the above arrangement, the present disclosure can achieve automatic dispensing of two detergents with different functions through one driving motor, and can accurately and quantitatively dispense each detergent. In addition, compared to the traditional arrangement of two motors and two pumping structures, the dispensing device of the present disclosure has a simple structure, can effectively reduce production and use costs, and improve product reputation.

BRIEF DESCRIPTION OF DRAWINGS

The dispensing device for a clothing treatment apparatus of the present disclosure will be described below with reference to the accompanying drawings. In the drawings.

DETAILED DESCRIPTION

Figure 1:
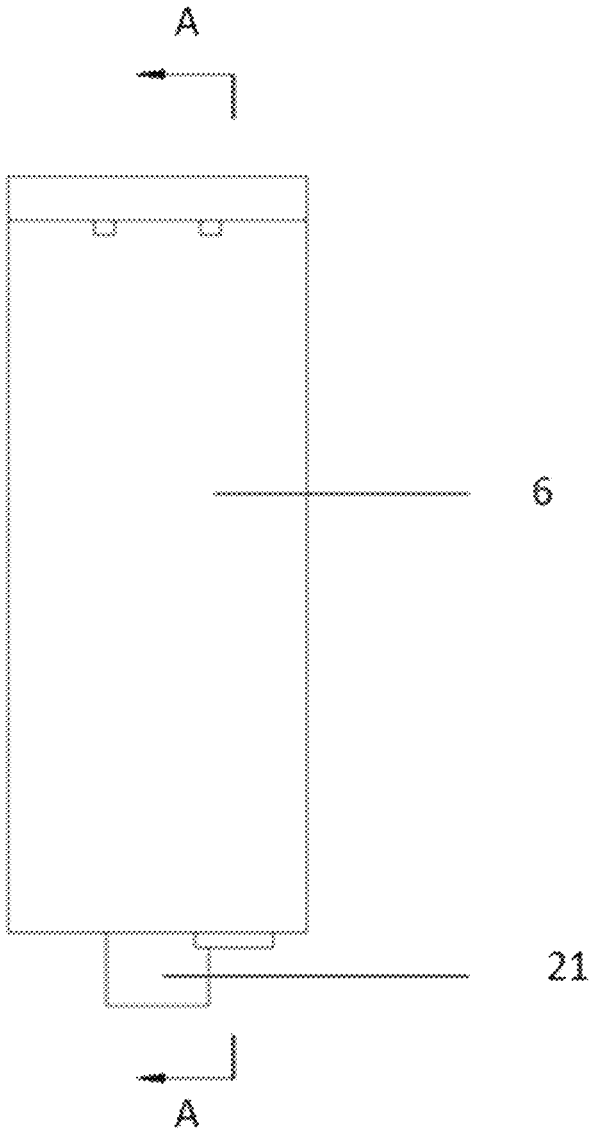
FIG. 1 is a schematic structural view of the dispensing device for a clothing treatment apparatus of the present disclosure.

Preferred embodiments of the present disclosure will be described below with reference to the accompanying drawings. It should be understood by those skilled in the art that these embodiments are only used to explain the technical principle of the present disclosure, and are not intended to limit the scope of protection of the present disclosure. Those skilled in the art can make adjustments as needed to adapt to specific application scenes. For example, although the first transmission assembly in the description is described as a cam and connection rod mechanism, it is obvious that the present disclosure can take various other forms, such as an eccentric wheel mechanism or a cam and spring mechanism, as long as the transmission assembly can dispense the first detergent.

It should be noted that in the description of the present disclosure, terms indicating directional or positional relationships, such as "center", "upper", "lower", "left", "right", "vertical", "horizontal", "inner", "outer" and the like, are based on the directional or positional relationships shown in the accompanying drawings. They are only used for ease of description, and do not indicate or imply that the device or element must have a specific orientation, or be constructed or operated in a specific orientation; therefore, they should not be considered as limitations to the present disclosure. In addition, terms "first", "second" and "third" are merely used for descriptive purpose, and should not be understood as indicating or implying relative importance.

In addition, it should also be noted that in the description of the present disclosure, unless otherwise clearly specified and defined, terms "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be internal communication between two elements. For those skilled in the art, the specific meaning of the above terms in the present disclosure can be interpreted according to specific situations.

As shown in FIGS. 1 to 4, in order to solve the problem of complicated structure caused by the use of two sets of pumping structures and motors in the dispensing devices of existing washing machines, the dispensing device for a clothing treatment apparatus of the present disclosure includes: two installation bodies 1; a power unit 2, which includes a driving part 21 and a gear lever 22, in which the gear lever 22 is rotatably arranged between the two installation bodies 1, and the driving part 21 is drivingly connected to the gear lever 22; a first dispensing unit 3, which includes a first dispensing rod 31 and a first gear 32, in which the first dispensing rod 31 is rotatably arranged between the two installation bodies 1, a first end of the first dispensing rod 31 is provided with a first limiting part 311, and a second end of the first dispensing rod 31 is provided with a first slippery part 32; a first threaded part 313 is arranged between the first limiting part 311 and the first slippery part 312; the first gear 32 is provided with a threaded hole, and the first gear 32 is threadedly connected to the first threaded part 313 through the threaded hole; after being connected, the first gear 32 is meshed and connected to the gear lever 22, and the first dispensing rod 31 is connected to a first transmission assembly 51 of a first detergent dispensing chamber 5; and a second dispensing unit 4, which includes a second dispensing rod 41 and a second gear 42, in which the second dispensing rod 41 is rotatably arranged between the two installation bodies 1, a first end of the second dispensing rod 41 is provided with a second limiting part 411, and a second end of the second dispensing rod 41 is provided with a second slippery part 412; a second threaded part 413 is arranged between the second limiting part 411 and the second slippery part 412; the second gear 42 is provided with a threaded hole, and the second gear 42 is threadedly connected to the second threaded part 413 through the threaded hole; after being connected, the second gear 42 is meshed and connected to the gear lever 22, and the second dispensing rod 41 is connected to a second transmission assembly of a second detergent dispensing chamber. The above driving part 21 may be a driving motor that can rotate in two directions, and of course may also be a combination of a driving motor and a transmission mechanism; for example, the transmission mechanism is a transmission gear, etc.

Figure 3:
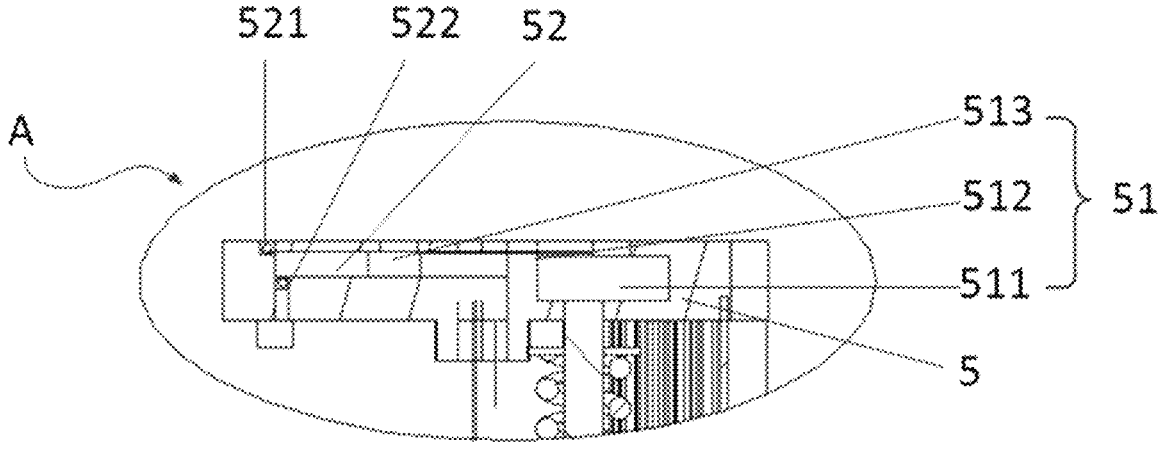
FIG. 3 is a partially enlarged view of a portion A in FIG. 2.
Figure 4:
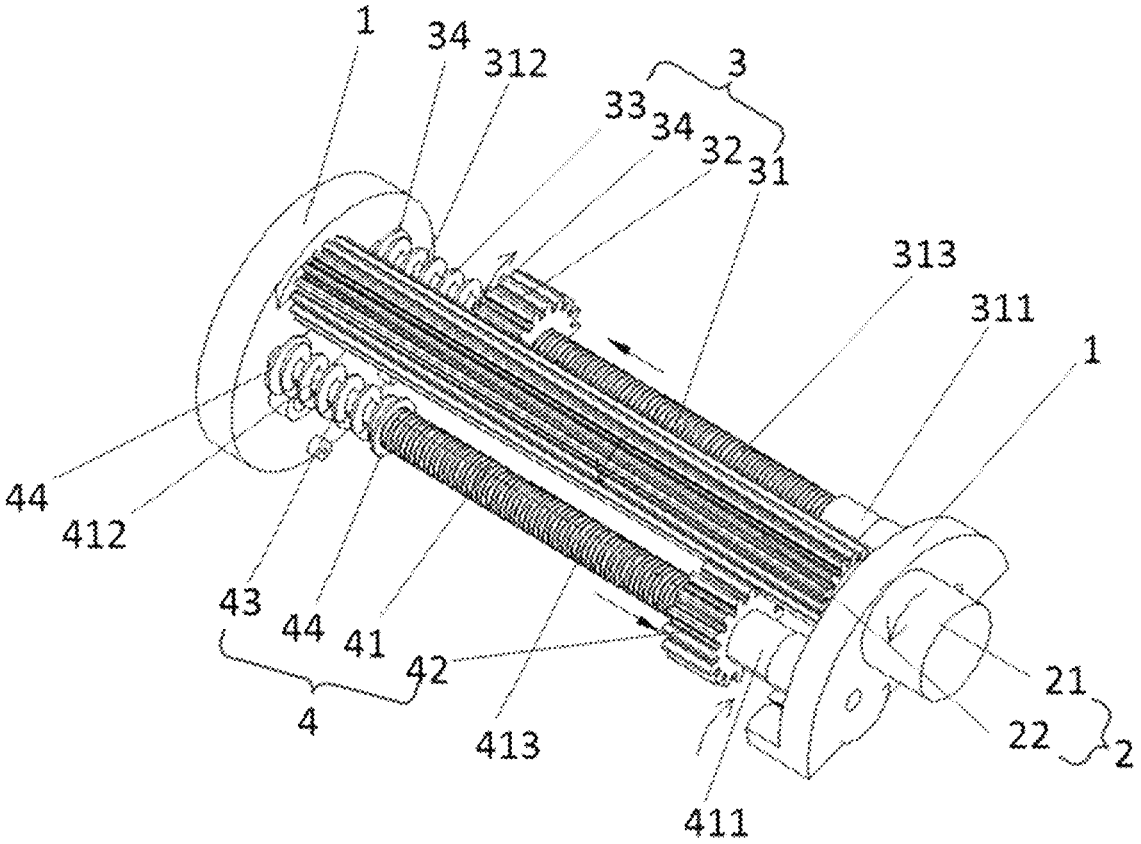
FIG. 4 is a schematic view of a partial structure when the driving part of the clothing treatment apparatus of the present disclosure rotates in the reverse direction.

Referring to FIGS. 3 and 4, when the driving part 21 drives the gear lever 22 to rotate in a forward direction, the first gear 22 moves toward the first limiting part 311 and the second gear 42 moves toward the second slippery part 412 until the first gear 32 moves to reach the first limiting part 311 and drives the first dispensing rod 31 to rotate, so that the first dispensing rod 31 drives the first transmission assembly 51 to move to achieve dispensing of detergent inside the first detergent dispensing chamber 5, and at the same time, the second gear 42 reaches the second slippery part 412 to achieve slip-rotation. With continued reference to FIG. 4, when the driving part 21 drives the gear lever 22 to rotate in a reverse direction, the first gear 32 moves toward the first slippery part 312 and the second gear 42 moves toward the second limiting part 411 until the second gear 42 moves to reach the second limiting part 411 and drives the second dispensing rod 41 to rotate, so that the second dispensing rod 41 drives the second transmission assembly to move to achieve dispensing of detergent inside the second detergent dispensing chamber, and at the same time, the first gear 32 reaches the first slippery part 312 to achieve slip-rotation.

The first dispensing rod 31 and the second dispensing rod 41 have a certain pre-tightening force between the two installation bodies 1, and rotation occurs only when the torque received by the first dispensing rod 31 and the second dispensing rod 41 reaches a preset torque. Taking the first dispensing unit 3 as an example for explanation, when the first gear 32 moves on the first threaded part 313, the movement is very smooth, and the torque brought to the first dispensing rod 31 is much smaller than the preset torque, so it is not sufficient to cause the first dispensing rod 31 to rotate. In addition, due to the slip-rotation of the first gear 32 on the first slippery part 312, the friction force is very small and is not sufficient to cause the first dispensing rod 31 to rotate. Only when the first gear 32 moves to the first limiting part 311, since further movement of the first gear 32 is limited by the first limiting part 311, but the first gear 32 is still continuously subjected to the force transmitted from the gear lever 22, the first dispensing rod 31 will be subjected to the force transmitted from the first gear 32. As a result, the first dispensing rod 31 obtains a larger torque until the torque received exceeds the preset torque, so that the first dispensing rod 31 starts to rotate and further drives the first transmission assembly 51 to achieve dispensing of detergent inside the first detergent dispensing chamber 5.

The advantage of the above arrangement is that the dispensing device of the present disclosure can achieve automatic dispensing of two detergents with different functions through one driving motor, and can accurately and quantitatively dispense each detergent. For example, by controlling a forward rotation time and a reverse rotation time of the driving motor, the quantitative dispensing of different detergents can be achieved (for example, a dispensing rate of the detergent is known, and the dispensing amount of the detergent can be determined according to the rotation time of the driving motor). In addition, compared to the traditional arrangement of two motors and two pumping structures, the dispensing device of the present disclosure has a simple structure, can effectively reduce production and use costs, and improve product reputation.

With continued reference to FIG. 4, in a possible embodiment, the first limiting part 311 and the second limiting part 411 are located on the same side, the first slippery part 312 and the second slippery part 412 are located on the same side, and the first threaded part 313 and the second threaded part 413 have different helical directions of thread.

For example, when the gear lever 22 rotates in the forward direction (i.e., clockwise, the same below), the first gear 32 and the second gear 42 rotate in the reverse direction (i.e., counterclockwise, the same below). Since the first limiting part 311 and the second limiting part 411 are located on the same side, and the first slippery part 312 and the second slippery part 412 are located on the same side, only when the first threaded part 313 and the second threaded part 413 have different helical directions of thread (for example, the first threaded part 313 is a left-hand thread and the second threaded part 413 is a right-hand thread; or the first threaded part 313 is a right-hand thread and the second threaded part 413 is a left-hand thread) can it be ensured that the first gear 32 moves toward the first limiting part 311 and the second gear 42 moves toward the second slippery part 412, thereby ensuring separate dispensing of the two detergents.

In an alternative embodiment, the first limiting part 311 and the second slippery part 412 are located on the same side, the second limiting part 411 and the first slippery part 312 are located on the same side, and the first threaded part 313 and the second threaded part 413 have the same helical direction of thread.

For example, when the gear lever 22 rotates in the forward direction, the first gear 32 and the second gear 42 rotate in the reverse direction. Since the first limiting part 311 and the second slippery part 412 are located on the same side, the second limiting part 411 and the first slippery part 312 are located on the same side, only when the first threaded part 313 and the second threaded part 413 have the same helical direction of thread (for example, the first threaded part 313 and the second threaded part 413 are left-hand threads; or the first threaded part 313 and the second threaded part 413 are right-hand threads) can it be ensured that the first gear 32 moves toward the first limiting part 311 and the second gear 42 moves toward the second slippery part 412, thereby ensuring separate dispensing of the two detergents.

Figure 2:
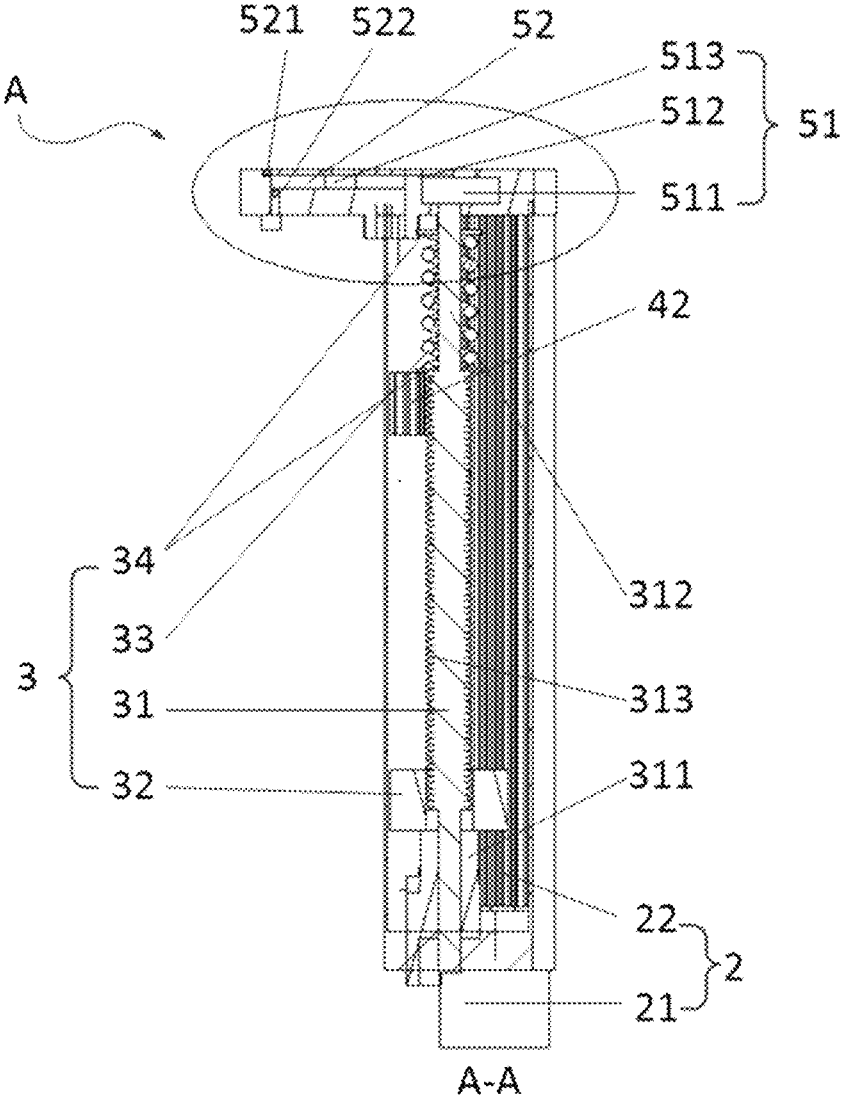
FIG. 2 is a cross-sectional view taken along line A-A in FIG. 1.

With continued reference to FIGS. 2 and 4, in a possible embodiment, the first dispensing unit 3 further includes a first elastic member 33, which is located on a side close to the first slippery part 312, provided between the installation body 1 and the first threaded part 313, and arranged on a movement travel of the first gear 32; and/or the second dispensing unit 4 further includes a second elastic member 43, which is located on a side close to the second slippery part 412, provided between the installation body 1 and the second threaded part 413, and arranged on a movement travel of the second gear 42. In a preferred embodiment, both the first elastic member 33 and the second elastic member 43 are springs; of course, they can also be elastic members such as elastic sheets.

The advantage of the above arrangement is that when the first gear 32 moves to the first slippery part 312, since the first elastic member 33 on this side is arranged on the movement travel of the first gear 32 and located between the installation body 1 and the first threaded part 313, the first gear 32 will abut against the first elastic member 33, causing the first elastic member 33 to be elastically deformed due to a squeezing force. Under the action of an elastic force generated by the first elastic member 33 due to the elastic deformation, the first gear 32 slip-rotates on the first slippery part 312 while also closely abutting against the thread of the first threaded part 313, so that the first gear 32 does not detach from the first threaded part 313. Therefore, when the first gear 32 rotates in the reverse direction, the first elastic member 33 begins to release the elastic force, thereby pushing the first gear 32 quickly into the first threaded part 313, so that the first gear 32 moves in the opposite direction more smoothly without jamming; on the other hand, the first elastic member 33 is close to the first slippery part 312, rather than being directly connected to the first slippery part 312, which can avoid transmission of partial force to the first dispensing rod 31, reduce the degree of force applied on the first dispensing rod 31, and thus avoid causing rotation of the first dispensing rod 31 in the event of loosening of the first dispensing rod 31. Similarly, when the second gear 42 moves to the second slippery part 412, the same principle applies.

Further, in a preferred embodiment, the first elastic member 33 is sleeved over the first slippery part 312, and/or the second elastic member 43 is sleeved over the second slippery part 412.

The advantage of the above arrangement is that since the first elastic member 33 is sleeved over the first slippery part 312, i.e., the first elastic member 33 is movably arranged, when the first elastic member 33 is subjected to the squeezing force of the first gear 32, the first elastic member 33 can move adaptively as the first gear 32 rotates. For example, if the friction between the first gear 32 and the first elastic member 33 is small, the first elastic member 33 can rotate slightly as the first gear 32 rotates, and if the friction between the first gear 32 and the first elastic member 33 is large, the first elastic member 33 can rotate as the first gear 32 rotates. In contrast, if the first elastic member 33 is rigidly connected to the installation body 1, the connection point thereof is prone to long-term stress and damage. Therefore, this arrangement can improve the service life of the first elastic member 33. The same applies to the second elastic member 43.

Further, a first gasket 34 is arranged between the first elastic member 33 and the first threaded part 313, as well as between the first elastic member 33 and the installation body 1, and/or a second gasket 44 is arranged between the second elastic member 43 and the second threaded part 413, as well as between the second elastic member 43 and the installation body 1.

The advantage of the above arrangement is that it can increase a contact area of the first elastic member 33, the first gear 32 and the installation body 1, preventing wear of the first elastic member 33 or the first gear 32 or the installation body 1. The same applies to the second gasket 44.

Of course, in another possible embodiment, there may be no elastic member arranged between the gear and the installation body 1. When the first gear 32 slip-rotates on the first slippery part 312, a small part of the first gear 32 can be threadedly connected to the first threaded part 313, and most of the first gear 32 is on the first slippery part 312. For example, by designing the length of the first slippery part 312, one end of the first gear 32 is designed to abut against the installation body 1, and a small part of the threaded hole at the other end threadedly contacts the first threaded part 313, thereby enabling the first gear 32 to slip-rotate in situ while also not completely detaching from the first threaded part 313. Therefore, when a driving direction changes, the first gear 32 can enter the first threaded part 313 and further move toward the first limiting part 311, thus completing the corresponding dispensing function; for the rotation of the second gear 42 on the second slippery part 412, the same arrangement can be made, and the principle is the same.

Alternatively, in a case where the first limiting part 311 and the second slippery part 412 are located on the same side, the second limiting part 411 and the first slippery part 312 are located on the same side, and the first threaded part 313 and the second threaded part 413 have the same helical direction of thread, the first slippery part 312 and the second slippery part 412 are arranged in an inclined manner above the horizontal direction, i.e., having an included angle of 0-180° with the horizontal direction. Through such an arrangement, when the first gear 32 or the second gear 42 moves to the first slippery part 312 or the second slippery part 412 when driven by the gear lever 22, the first gear 32 or the second gear 42 starts to slip-rotate. When the first gear 32 or the second gear 42 moves in the opposite direction, under the gravity of the first gear 32 or the second gear 42, the first gear 32 or the second gear 42 enters the first threaded part 313 or the second threaded part 413, and then the first gear 32 or the second gear 42 moves in the opposite direction under the action of the first gear 32 or the second gear 42.

In a preferred embodiment, the first slippery part 312 and the second slippery part 412 are smooth columnar rods.

The advantage of the above arrangement is that since the first slippery part 312 and the second slippery part 412 are smooth columnar rods, the friction coefficient between the first gear 32 and the second gear 42 can be reduced, thus enabling the first gear 32 and the second gear 42 to achieve smoother self-rotation on the first slippery part 312 and the second slippery part 412, so that wear of the threaded holes of the first gear 32 and the second gear 42 can be avoided.

In a preferred embodiment, the first limiting part 311 and the second limiting part 411 are of an annular convex structure.

The above arrangement has the following advantage: since the first limiting part 311 and the second limiting part 411 are of an annular convex structure, taking the first limiting part 311 as an example for explanation, when the first gear 32 moves to the first limiting part 311, the first limiting part 311 will abut against the first gear 32 and restrict the first gear 32 from continuing to move, and then the first dispensing rod 31 will be subjected to the force transmitted from the first gear 32, so that the first dispensing rod 31 is driven to rotate, In addition, the annular convex structure is simple and can be easily manufactured, which can reduce production and use costs.

With continued reference to FIGS. 2 and 3, in a possible embodiment, a first piston chamber 52 is arranged inside the first detergent dispensing chamber 5, and the first piston chamber 52 is provided with a first detergent inlet 521 and a first detergent outlet 522; a one-way valve is arranged at the first detergent inlet 521 and the first detergent outlet 522 respectively; the first transmission assembly 51 includes a first cam 511, a first connecting rod 512, and a first piston 513; the first dispensing rod 31 is fixedly connected to the first cam 511, the first cam 511 is hinged with the first connecting rod 512, the first connecting rod 512 is hinged with the first piston 513, and the first piston 513 is movably arranged in the first piston chamber 52; a second piston chamber is arranged inside the second detergent dispensing chamber, and the second piston chamber is provided with a second detergent inlet and a second detergent outlet; a one-way valve is arranged at the second detergent inlet and the second detergent outlet respectively; the second transmission assembly includes a second cam, a second connecting rod, and a second piston; the second dispensing rod 41 is fixedly connected to the second cam, the second cam is hinged with the second connecting rod, the second connecting rod is hinged with the second piston, and the second piston is movably arranged in the second piston chamber. In a preferred embodiment, the first detergent dispensing chamber 5 and/or the second detergent dispensing chamber can be arranged on the installation body 1 to reduce the volume of the dispensing device of the present disclosure and facilitate installation in the washing machine; of course, the first detergent dispensing chamber 5 and/or the second detergent dispensing chamber can also be arranged at positions such as the detergent box, as long as the first dispensing rod 31 is connected to the first transmission assembly 51 and/or the second dispensing rod 41 is connected to the second transmission assembly, all of which are within the scope of protection of the present disclosure.

Taking the first detergent dispensing chamber 5 as an example, when the first dispensing rod 31 rotates, it drives the first cam 511 to rotate, and then the rotational motion of the first cam 511 is converted into an up-and-down reciprocating motion of the first piston 513 in the first piston chamber 52 by the first connecting rod 512. When the first piston 513 moves downward, the one-way valve at the first detergent inlet 521 is opened, and the one-way valve at the first detergent outlet 522 is closed, thereby achieving suction of the first detergent. When the first piston 513 moves upward, the one-way valve at the first detergent outlet 522 is opened, and the one-way valve at the first detergent inlet 521 is closed, thereby achieving dispensing of the first detergent. A fixed-volume dispensing of the first detergent can be achieved according to the operation time and suction rate of the driving motor, thereby achieving precise control of the first detergent. The dispensing principle of the second detergent is the same as that of the first detergent and will not be described repeatedly.

In a preferred embodiment, the dispensing device further includes a shell 6, which covers the gear lever 22, the first dispensing unit 3 and the second dispensing unit 4, so as to achieve dust prevention, prevent entry of impurities, and provide protection and support for internal members, etc.

Of course, multiple dispensing units such as a third dispensing unit and a fourth dispensing unit can also be provided in the present disclosure. For example, in a case where the third dispensing unit is provided, if the structure of the third dispensing unit is the same as that of the first dispensing unit 3, then when the first dispensing unit 3 dispenses the detergent, the third dispensing unit also dispenses the detergent at the same time; and when the second dispensing unit 4 dispenses the detergent, the first dispensing unit and the third dispensing unit do not dispense the detergent. This arrangement may allow for the dispensing of various different detergents, and an appropriate number of the dispensing units can be selected according to needs.

In summary, the structure of the dispensing device for the washing machine of the present disclosure is simple, and two different detergents can be dispensed accurately and quantitatively through only one driving motor.

It should be noted that the above embodiments are only used to explain the principle of the present disclosure, and are not intended to limit the scope of protection of the present disclosure. Without departing from the principle of the present disclosure, those skilled in the art can adjust the above structure so that the present disclosure can be applied in more specific application scenes.

For example, in an alternative embodiment, the first slippery part 312 and/or the second slippery part 412 may also be rough columnar rods, or columnar rods with protrusions, as long as they enable the first gear 32 and/or the second gear 42 to slip-rotate, and the force transmitted by them is not sufficient to cause the first dispensing rod 31 and/or the second dispensing rod 41 to rotate, all of which do not depart from the principle of the present disclosure and therefore fall within the scope of protection of the present disclosure.

For example, in another alternative embodiment, the first elastic member 33 and/or the second elastic member 43 can be fixedly arranged on the installation body 1. For example, there are two first elastic members 33 and/or two second elastic members 43 arranged opposite to each other on both sides of the first slippery part 312 and/or the second slippery part 412, as long as the first gear 32 and/or the second gear 42 can be pushed to quickly enter the threaded part in the opposite direction, all of which do not depart from the principle of the present disclosure and therefore fall within the scope of protection of the present disclosure.

For example, in another alternative embodiment, the first limiting part 311 is provided with a first sticking member that can rebound in a reverse direction, and the first gear 32 is provided with a second sticking member that can rebound in a forward direction and is matched with the first sticking member; the second limiting part 411 is provided with a third sticking member that can rebound in a forward direction, and the second gear 42 is provided with a fourth sticking member that can rebound in a reverse direction and is matched with the third sticking member. For example, when the first gear 32 rotates in the reverse direction and moves to the first limiting part 311, the first sticking member and the second sticking member are stuck with each other, and the first gear 32 stops moving, thereby driving the first dispensing rod 31 to rotate; and when the first gear 32 rotates in the forward direction and the first sticking member touches the second sticking member, the first sticking member rotates in the forward direction and the second sticking member rotates in the reverse direction, which does not limit the forward rotation of the first gear 32, thereby ensuring that the first gear 32 enters the first threaded part 313. Therefore, those skilled in the art can make adjustments, as long as the first limiting part 311 and the second limiting part 411 can limit the first gear 32 and the second gear 42, all of which do not depart from the principle of the present disclosure and therefore fall within the scope of protection of the present disclosure.

For example, in another alternative embodiment, the number of the first gasket 34 and/or the number of the second gasket 44 of the present disclosure can each be set to 1. For example, the number of the first gasket can be set to 1, and the first gasket is arranged between the first elastic member 33 and the first threaded part 313, or between the first elastic member 33 and the installation body 1; the arrangement position of the second gasket 44 is similar, all of which do not depart from the principle of the present disclosure and therefore fall within the scope of protection of the present disclosure.

For example, in another alternative embodiment, the first transmission assembly 51 and/or the second transmission assembly may be a combination of an eccentric wheel mechanism or a cam and spring mechanism with a piston, as long as the first detergent and the second detergent can be dispensed, all of which do not depart from the principle of the present disclosure and therefore fall within the scope of protection of the present disclosure.

In addition, the present disclosure also provides a clothing treatment apparatus, which includes the dispensing device for a clothing treatment apparatus described in any of the above embodiments.

Finally, it should be noted that although the present disclosure is described by taking the washing machine as an example, it is obvious that the clothing treatment apparatus of the present disclosure can also be applied to other washing apparatuses. For example, the clothing treatment apparatus can also be applied to shoe washing machines, hosiery washing machines, and even dishwashers.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A dispensing device for a clothing treatment apparatus, the dispensing device comprising:

two installation bodies;

a power unit comprising a driving part and a gear lever, wherein the gear lever is rotatably arranged between the two installation bodies, and the driving part is drivingly connected to the gear lever;

a first dispensing unit comprising a first dispensing rod and a first gear, wherein the first dispensing rod is rotatably arranged between the two installation bodies, a first end of the first dispensing rod is provided with a first limiting part, and a second end of the first dispensing rod is provided with a first slippery part; a first threaded part is arranged between the first limiting part and the first slippery part; the first gear is provided with a threaded hole, and the first gear is threadedly connected to the first threaded part through the threaded hole; and after being connected, the first gear is meshed and connected to the gear lever, and the first dispensing rod is connected to a first transmission assembly of a first detergent dispensing chamber; and a second dispensing unit comprising a second dispensing rod and a second gear, wherein the second dispensing rod is rotatably arranged between the two installation bodies, a first end of the second dispensing rod is provided with a second limiting part, and a second end of the second dispensing rod is provided with a second slippery part; a second threaded part is arranged between the second limiting part and the second slippery part; the second gear is provided with a threaded hole, and the second gear is threadedly connected to the second threaded part through the threaded hole; and after being connected, the second gear is meshed and connected to the gear lever, and the second dispensing rod is connected to a second transmission assembly of a second detergent dispensing chamber; and when the driving part drives the gear lever to rotate in a forward direction, the first gear moves to reach the first limiting part and drives the first dispensing rod to rotate, so that the first dispensing rod drives the first transmission assembly to move to achieve dispensing of detergent inside the first detergent dispensing chamber, and at the same time, the second gear reaches the second slippery part to achieve slip-rotation; and when the driving part drives the gear lever to rotate in a reverse direction, the second gear moves to reach the second limiting part and drives the second dispensing rod to rotate, so that the second dispensing rod drives the second transmission assembly to move to achieve dispensing of detergent inside the second detergent dispensing chamber, and at the same time, the first gear reaches the first slippery part to achieve slip-rotation.

2. The dispensing device for the clothing treatment apparatus according to claim 1, wherein:

the first limiting part and the second limiting part are located on the same side, the first slippery part and the second slippery part are located on the same side, and the first threaded part and the second threaded part have different helical directions of thread.

3. The dispensing device for the clothing treatment apparatus according to claim 1, wherein:

the first limiting part and the second slippery part are located on the same side, the second limiting part and the first slippery part are located on the same side, and the first threaded part and the second threaded part have the same helical direction of thread.

4. The dispensing device for the clothing treatment apparatus according to claim 1, wherein:

the first dispensing unit further comprises a first elastic member, which is located on a side close to the first slippery part, provided between the installation body and the first threaded part, and arranged on a movement travel of the first gear; and/or the second dispensing unit further comprises a second elastic member, which is located on a side close to the second slippery part, provided between the installation body and the second threaded part, and arranged on a movement travel of the second gear.

5. The dispensing device for the clothing treatment apparatus according to claim 4, wherein:

the first elastic member is sleeved over the first slippery part, and/or the second elastic member is sleeved over the second slippery part.

6. The dispensing device for the clothing treatment apparatus according to claim 5, wherein:

a first gasket is arranged between the first elastic member and the first threaded part, as well as between the first elastic member and the installation body, and/or a second gasket is arranged between the second elastic member and the second threaded part, as well as between the second elastic member and the installation body.

7. The dispensing device for the clothing treatment apparatus according to claim 1, wherein:

the first slippery part and the second slippery part are smooth columnar rods.

8. The dispensing device for the clothing treatment apparatus according to claim 1, wherein:

the first limiting part and the second limiting part are of an annular convex structure.

9. The dispensing device for the clothing treatment apparatus according to claim 1, wherein:

a first piston chamber is arranged inside the first detergent dispensing chamber, and the first piston chamber is provided with a first detergent inlet and a first detergent outlet; a one-way valve is arranged at the first detergent inlet and the first detergent outlet respectively; the first transmission assembly comprises a first cam, a first connecting rod, and a first piston; the first dispensing rod is fixedly connected to the first cam, the first cam is hinged with the first connecting rod, the first connecting rod is hinged with the first piston, and the first piston is movably arranged in the first piston chamber; and/or a second piston chamber is arranged inside the second detergent dispensing chamber, and the second piston chamber is provided with a second detergent inlet and a second detergent outlet; a one-way valve is arranged at the second detergent inlet and the second detergent outlet respectively; the second transmission assembly comprises a second cam, a second connecting rod, and a second piston; the second dispensing rod is fixedly connected to the second cam, the second cam is hinged with the second connecting rod, the second connecting rod is hinged with the second piston, and the second piston is movably arranged in the second piston chamber.

10. A clothing treatment apparatus, comprising the dispensing device for the clothing treatment apparatus according to claim 1.

* * * * *